US005357638A

United States Patent [19]

Mayzel

[11] Patent Number: 5,357,638

[45] Date of Patent: Oct. 25, 1994

[54] BELT BUCKLE WITH CONDOM CONTAINER

[76] Inventor: John A. Mayzel, 1931 Hampshire Road, Victoria, British Columbia, V8R 5T9, Canada

[21] Appl. No.: 200,580

[22] Filed: Feb. 22, 1994

Related U.S. Application Data

[63] Continuation of Ser. No. 992,509, Dec. 17, 1992, abandoned.

[51] Int. Cl.[5] ..... A41F 9/00

[52] U.S. Cl. ..... 2/312; 2/336; 224/163; 224/252; 24/163 K

[58] Field of Search ..... 2/311, 312, 319, 321, 2/322, 336, 338; 224/163, 252; 206/69, 37; 24/178, 308, 265 BC, 170, 163 K

[56] References Cited

U.S. PATENT DOCUMENTS

| | | | |
|---|---|---|---|
| 603,974 | 5/1898 | Scheuber . | |
| 726,654 | 4/1903 | Dodge . | |
| 749,995 | 1/1904 | Johnson . | |
| 1,022,508 | 4/1912 | Rust | 24/265 BC |
| 1,490,199 | 4/1924 | Buchsbaum | 24/308 |
| 1,508,963 | 12/1923 | Dorf . | |
| 1,606,849 | 11/1926 | Spear | 224/163 |
| 1,763,100 | 6/1930 | Mendosa | 24/265 BC |
| 1,784,794 | 12/1930 | Rosenberg | 24/163 K |
| 4,068,787 | 1/1978 | Craighead . | |
| 4,209,117 | 6/1980 | Corinaldi et al. . | |
| 4,437,598 | 3/1984 | Hull | 24/163 K |
| 4,753,377 | 6/1988 | Poluhowich . | |
| 4,805,820 | 2/1989 | Kearney et al. | 224/252 |
| 4,892,188 | 1/1990 | Meadows . | |

*Primary Examiner*—Clifford D. Crowder
*Assistant Examiner*—Gloria Hale
*Attorney, Agent, or Firm*—Norman M. Cameron

[57] ABSTRACT

A belt buckle has a storage space dimensioned to receive a condom. There is a cover for the storage space, and a latch which releasibly engages the cover over the storage space. The latch is releasible only when the belt buckle is unbuckled. The cover may be hingedly connected to the body and may have a boss which passes through an aperture in the body to engage an aperture in the belt when the belt buckle is buckled.

7 Claims, 4 Drawing Sheets

BELT BUCKLE WITH CONDOM CONTAINER

BACKGROUND OF THE INVENTION

This application is a continuation of application Ser. No. 07/992,509, filed Dec. 17, 1992, now abandoned.

FIELD OF THE INVENTION

This invention relates to belts and belt buckles having storage spaces for condoms and other articles.

Public health authorities and others have recently been stressing the importance of using condoms during sexual intercourse to prevent the spread of sexually transmitted diseases, notably AIDS. Various measures have been taken to try and increase the use of condoms, such as providing them free or placing condom vending machines in school washrooms. However, a high percentage of sexual intercourse occurs without the use of condoms, partly because the activities were unplanned or for other reasons no one thought to bring a condom. Accordingly, there is a pressing need for some means for trying to ensure that individuals have condoms on hand when sexual activities occur. At the same time, the condom must be preserved intact, and not subject to abrasions or other stresses which could cause it to fail in use.

DESCRIPTION OF RELATED ART

Various belts and belt buckles have been proposed which have a compartment for holding small items. An example is the money buckle shown in U.S. Pat. No. 4,068,787 to Craighead. This includes a safety flap accessible from the back of the buckle, but has only a small cavity for receiving paper valuables.

U.S. Pat. No. 1,508,963 to Dorf also has a compartment which requires access to the back side of the belt, either by removing it or twisting it.

U.S. Pat. No. 749,995 to Johnson shows a small container which forms a buckle. However, the volume is necessarily small because it is arranged on the front of the belt or strap.

U.S. Pat. No. 4,209,117 to Corinaldi et al. shows a belt buckle with a pivoting tray. As with some of the other belt buckles with containers in the prior art, it can be opened inadvertently from the front, potentially causing loss of the contents, or possible embarrassment to the wearer depending upon the contents.

U.S. Pat. No. 4,892,118 to Meadows shows a condom case, but not one incorporated with a belt buckle.

U.S. Pat. No. 4,437,598 to Hull shows a type of belt buckle having a boss or peg for inserting into apertures in the belt and a slot through which the belt slides. There is a hidden compartment for money and papers. The belt acts as a closure for the compartment.

Accordingly it is an object of the invention to provide a belt buckle with a compartment dimensioned to contain a condom but which is also useful for other articles as well.

It is also an object of the invention to provide an improved belt buckle container for condoms or the like which cannot open accidentally in use, thus revealing the contents at an embarrassing moment.

It is a further object of the invention to provide an improved belt buckle with a container suitable for a condom which can be opened and closed without causing abrasion to the condom and possible failure thereof in use.

SUMMARY OF THE INVENTION

In accordance with these objects, the invention provides a belt buckle having a body with a storage space dimensioned to receive a condom. There is a cover for the storage space. A latch releasibly engages the cover over the storage space. The latch is releasible only when the belt buckle is unbuckled.

The cover may have a first end hingedly connected to the body, the latch being near a second end thereof.

DESCRIPTION OF THE PREFERRED EMBODIMENTS

Figure 1:
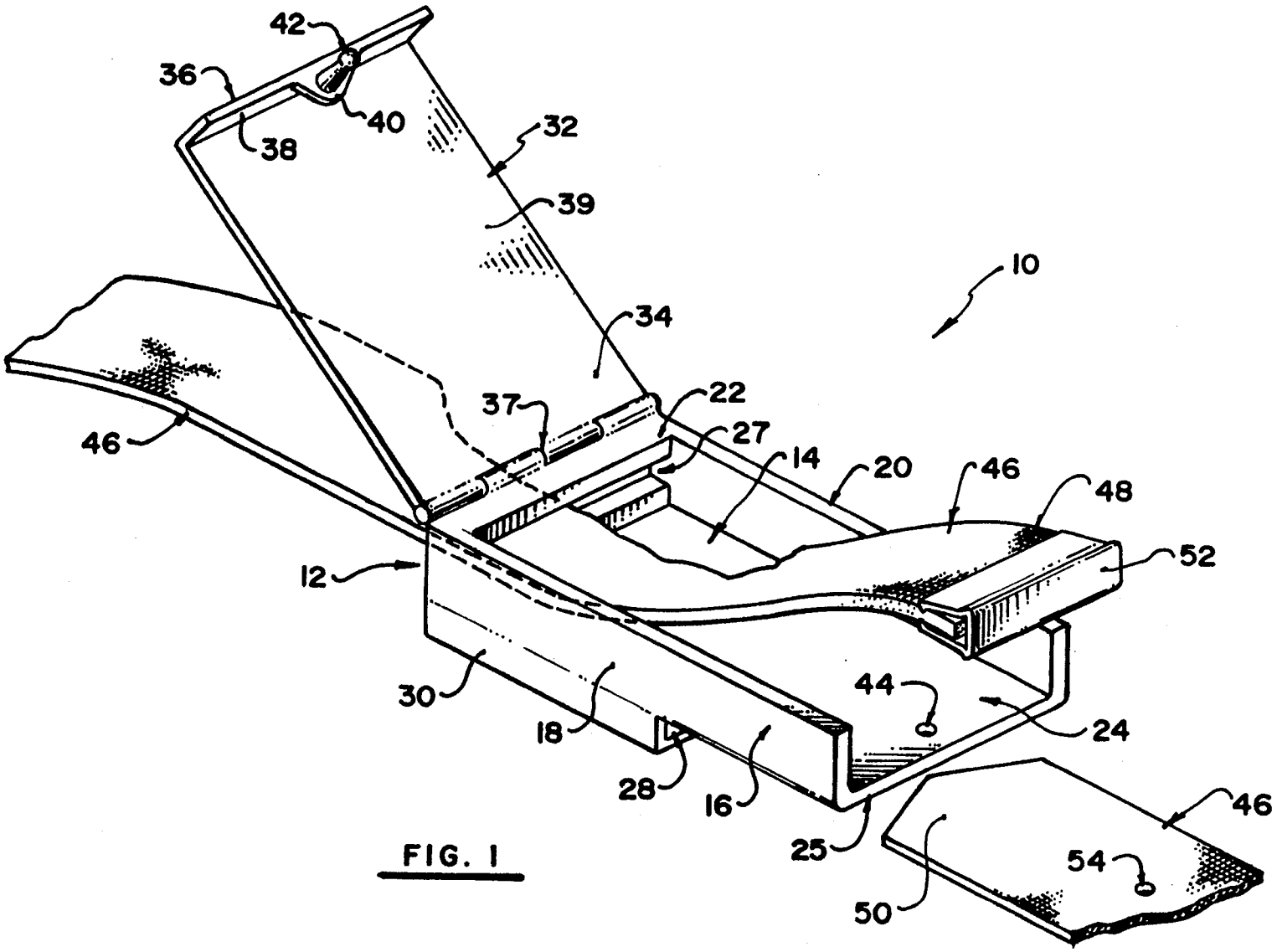
FIG. 1 is a top, isometric view of a belt according to the invention having a belt buckle with an interior storage space dimensioned to receive a condom, and a strap or belt which is shown in fragment.
Figure 2:
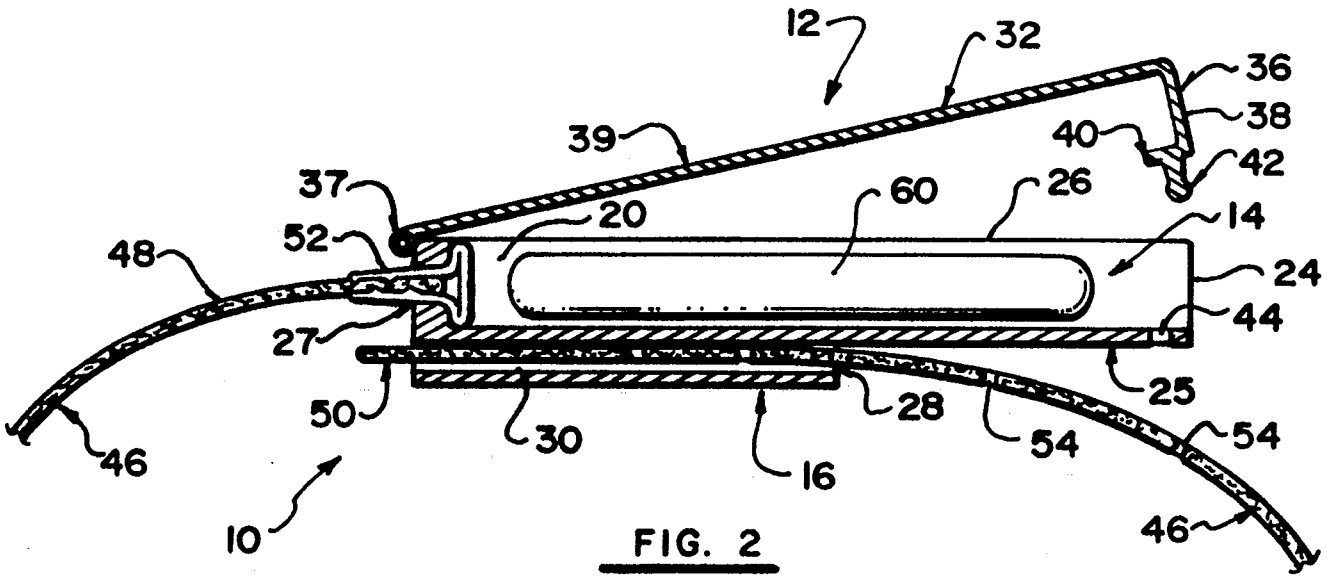
FIG. 2 is a top view of the belt of FIG. 1 with the cover partly opened and the top of the buckle being broken away to show a condom in the storage container.

Referring to FIG. 1 and 2, these show a belt 10 which includes a belt buckle 12 having an interior storage space 14. The storage space is within body 16 of the buckle which has a top 18, a bottom 20, a first end 22 and an open second end 24. The body also has a back 25 which is rectangular and accordingly defines the shape of the storage space 14. The body has a rectangular opening on front 26 which is on the side opposite the back.

The body 16 of the belt buckle has a first slot 27 extending along first end 22. The slot is outwardly tapered in this embodiment, as seen best in FIG. 2. The body also has a second slot 28 formed on back 25 thereof by a projection 30 thereon.

The belt buckle 12 also has a cover 32 which has a rectangular front 39 in this particular embodiment having dimensions similar to front 26 of the body 16. The cover has a first end 34 and a second end 36. There is a hinge 37 adjacent the first end which hingedly connects the cover to the body adjacent the front and first end 22 thereof.

The cover has an end plate 38 on the second end thereof extending perpendicularly from front 39 of the cover. There is a tab 40 extending perpendicularly from the end-plate and spaced-apart from front 39. A boss 42 extends rearwardly from the tab and in this example is in the form of a stem with a knob on the end thereof.

As may be appreciated from FIG. 2, the cover may be closed by pivoting it downwards from the illustrated position about hinge 37. Front 39 of the cover then covers front 26 of the body 16, while end plate 38 of the cover covers second end 24 of the body to close the storage space 14. When this occurs, boss 42 projects through small aperture 44 in back 25 of body 16. The boss is retained in the aperture by friction or a snapping action.

The belt 10 also includes a strap 46 which is of leather in this embodiment, although flexible plastics cloth or the like could be substituted. The configuration is generally conventional, the strap having a first end 48 and a second end 50. There is an enlarged fitting 52 clamped onto the first end 48 of the strap. The first end of the belt fits through slot 27 in first end 22 of the body 16. The fitting 52 is jammed in the tapered slot 27, thus securing the first end of the belt to the buckle.

The second end of the strap, also referred to as the "free end", has a series of spaced-apart small apertures 54. The wearer loops the belt around his or her waist, typically through belt loops on trousers, and brings end 50 of the belt through the first slot 28 in body 16 of the buckle as illustrated in FIG. 2. It is tightened until a convenient aperture 54 is located immediately behind aperture 44 in the body. Boss 42 of the cover is then fitted through the appropriate aperture 54 to secure the belt in place.

When the wearer wishes to retrieve the condom, the buckle and strap are pulled apart so that the boss 42 is released from the aperture 54. The cover is then hinged open about hinge 37 so condom 60, shown in FIG. 2, can be removed. Thus the boss 42 engaging the aperture 54 of the belt acts as a releasible latch accessible only from the rear of the buckle to ensure that the condom is not accidentally exposed.

Figure 4:
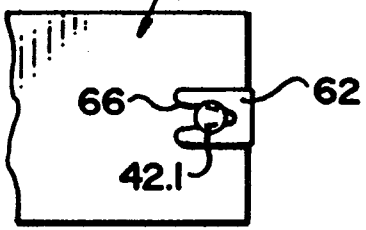
FIG. 4 is a fragmentary rear view of the embodiment of FIG. 3.
Figure 3:
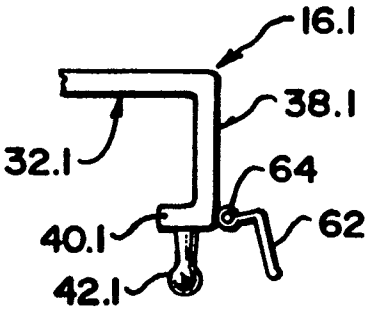
FIG. 3 is a top, fragmentary view of an alternative embodiment having a clasp for ensuring the cover remains closed.

Increased security may be achieved by adding a clasp 62 on alternative cover 32.1 shown in FIG. 3 and 4. The clasp is connected to end plate 38.1 adjacent tab 40.1 by a hinge 64. The clasp has a slot 66 which engages boss 42 in a snap-like manner when the clasp is rotated about the hinge as shown in FIG. 4. Thus, the clasp acts as an additional security device to prevent the cover 32.1 from opening accidentally unless the clasp is first rotated away from the boss 42.1 as seen in FIG. 3.

Figure 5:
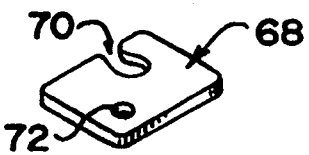
FIG. 5 is a top, front isometric view of an alternative clasp.

Another type of clasp is shown in FIG. 5. In this case, clasp 68 has a slot 70 for engaging the boss. However, it is pivotally connected to the back of the body 16 by means of a pin through aperture 72 in the clasp. Thus, it is rotated into engagement with the boss or away from the boss in the same plane as the back of the body of the buckle.

Another embodiment of the invention is shown in FIG. 6–9 inclusive. Belt 80 includes a strap 82 and a buckle 86. The strap has a plurality of spaced-apart apertures 84 as is conventional. The buckle 86 has a generally conventional loop-shaped member 88 forming an open rectangular loop. The buckle has a tongue 90 hingedly connected to back 92 of the loop member by a hinge 94. There is a cover 96 connected to the loop member at points 97 and 99 near front 98 thereof. The cover is generally rectangular and is angled away from the loop member approximately 30° in this embodiment as shown by angle 101 in FIG 9. There is an opening 100 between the front 98 of the loop member and edge 102 of the cover.

Figure 6:
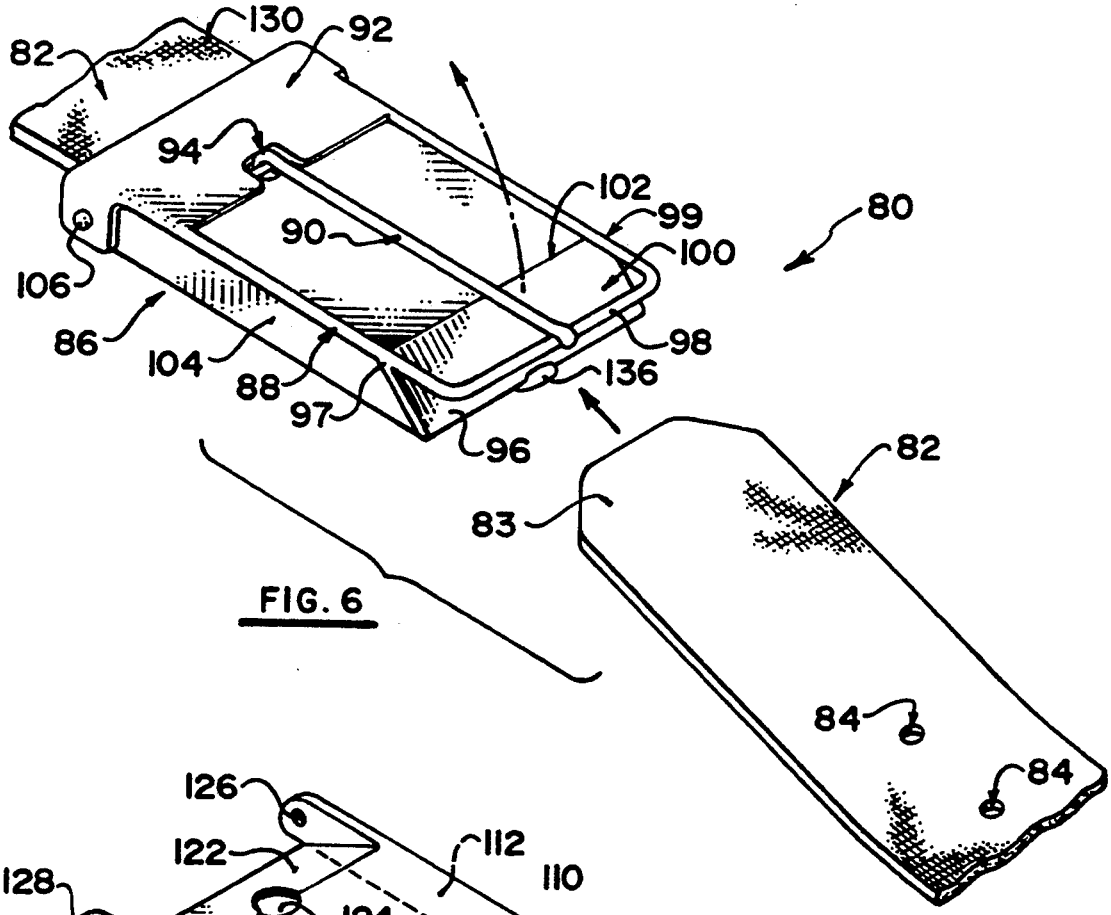
FIG. 6 is a top, side isometric view of a belt buckle according to another embodiment of the invention, showing the belt in fragment.
Figure 9:
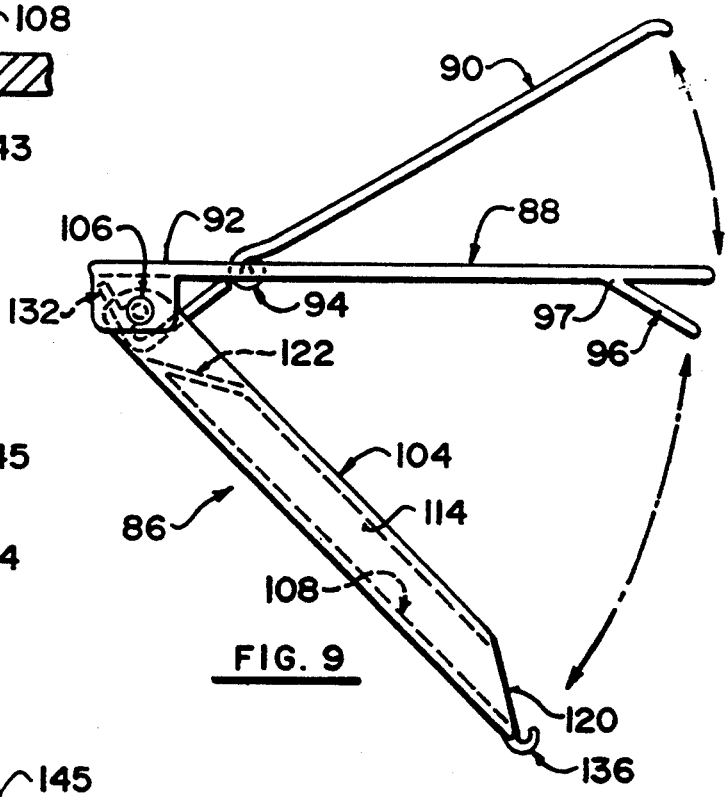
FIG. 9 is a side view of the buckle of the embodiment of FIG. 6 with the tongue raised and the condom container open.

A condom container 104, preferably of plastic, is connected to the loop-shaped member 88 by a hinge pin 106 as seen in FIG. 6 and FIG. 9. As seen best in FIG. 7, the condom container has a closed back panel 108, which is rectangular in this embodiment and a smaller front panel 110. There are sides 112 and 114 extending from the front to back panels. The condom container is generally trapezoidal in section. A first side 116 is open and adjoins tapered ends 118 and 120 of sides 112 and 114 respectively. There is a rectangular member 122 at the opposite end of the container at a generally similar angle. An opening 124 provides clearance for the tongue 90 where it is hinged about pin 94.

Figure 7:
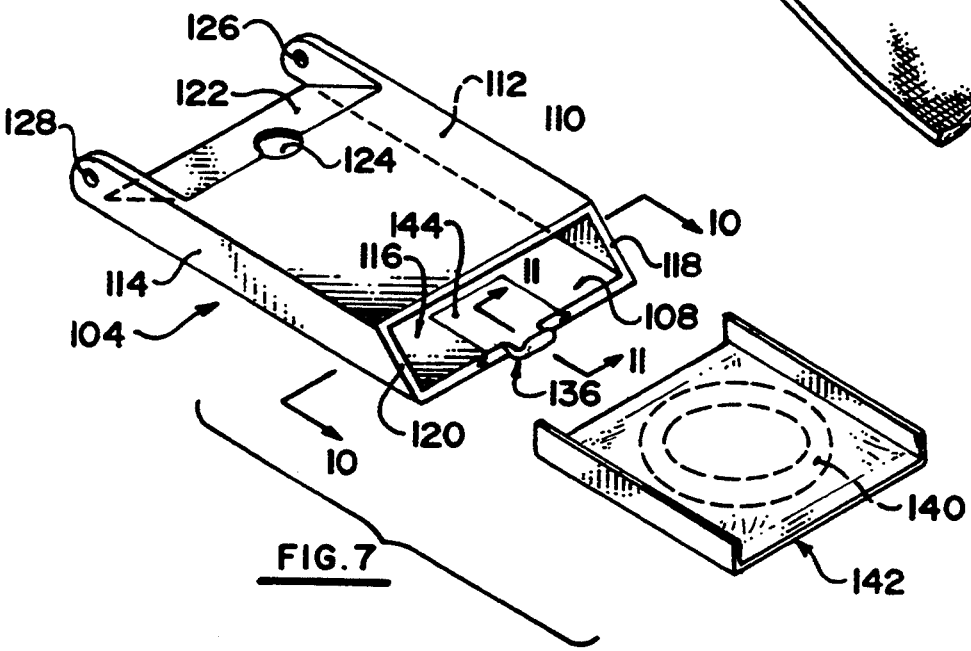
FIG. 7 is a top, side isometric view of the condom container thereof, showing the condom removed from the container.
Figure 8:
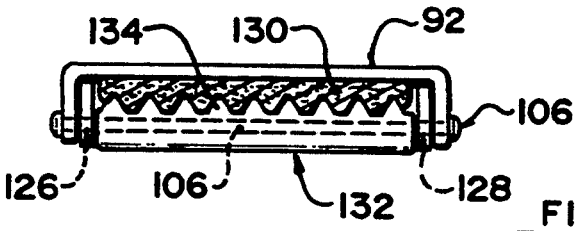
FIG. 8 is an end view of the buckle of the embodiment of FIG. 6.

Openings 126 and 128 on the condom container receive pin 106 to pivotally connect the condom container to loop member 88. FIG. 6 shows the condom container in the closed position with cover 100 fitted over open end 116 of the container. FIG. 7 shows the container open.

End 130 of the strap is connected to the buckle by a clamp 132 which is also hinged about pin 106. The clamp has a serrated edge 134 which secures end 130 of the strap.

Figure 10:
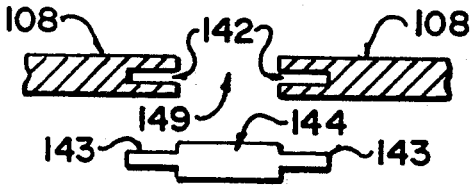
FIG. 10 is a sectional view taken along line 10—10 of FIG. 7.
Figure 11A:
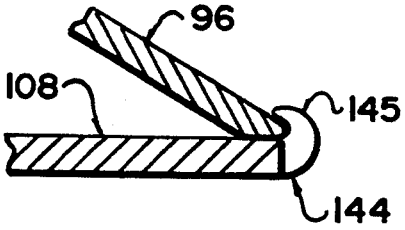
FIG. 11*a* is a sectional view taken along line 11—11 of FIG. 7 showing a different clasp which is closed.
Figure 11B:
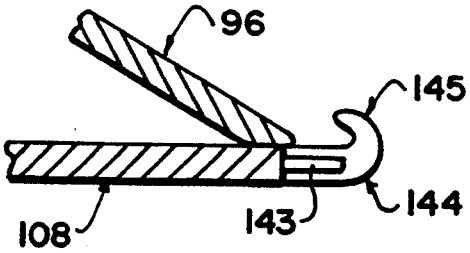
FIG. 11*b* is a view similar to FIG. 11*a* with the clasp open.
Figure 12A:
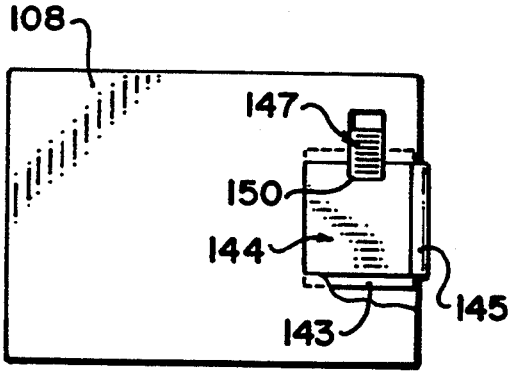
FIG. 12*a* is a top plan of the back of the condom container of FIG. 7 with the clasp locked.
Figure 12B:
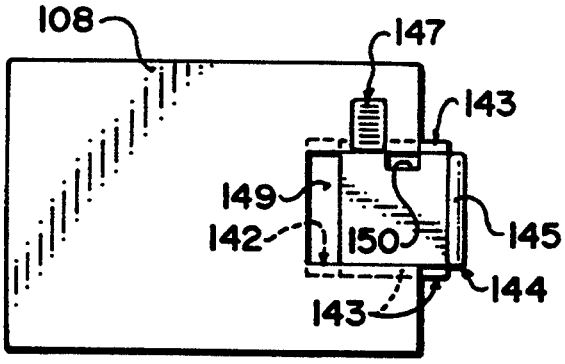
FIG. 12*b* is a view similar to FIG. 12*a* with the clasp unlocked.

There is a clasp 136 which normally holds cover 96 in place over the open end 116 of the condom container as seen in FIG. 6. FIG. 7 shows the clasp released and the container open. This may be a friction clamp or a snap fastener. Referring to FIG. 10, 11*a*, 11*b*, 12*a* and 12*b*show a variation of the invention with a sliding clasp 144. The clasp is shown in FIG. 10 removed from its normal position shown in FIG. 11*a*, 11*b*, 12*a* and 12*b* where rails 143 of the clasp engage slots 142 on each side of opening 149 on back panel 108 of the condom container. The clasp has a hook 145 which engages cover 96 when the container is closed as seen in FIG. 11*a* and FIG. 12*a*. FIG. 11*b* and FIG. 12*b* show the clasp open. There is a sliding lock 147 which engages recess 150 of the clasp to ensure it stays closed as soon in FIG. 12*a*. FIG. 12*b* shows the clasp unlocked by sliding in the direction of a now 151 so it can be opened.

End 82 of the strap can be inserted through opening 100 and the tongue 90 can be inserted through one of the apertures 84 to secure the belt in place in the usual way. In order to retrieve a condom, the belt must be unbuckled and the cover 96 can be unlatched from clasp 136 and opened to the position shown in FIG. 9. This allows a condom 140, with its package 142 folded, to be fitted into the container through open ends 116 or removed therefrom.

It will be understood by someone skilled in the art that many of the details described above are by way of example only, and can be altered or deleted without departing from the scope of the invention, which is to be interpreted with reference to the following claims.

What is claimed is:

1. A belt buckle, comprising:

a loop-shaped member having a front and a back;

a elongated tongue hingedly connected to the back of the loop-shaped member and extending to the front thereof on one side thereof;

means for connecting a first end of a belt to the back of the loop-shaped member;

a container hingedly connected to the back of the loop-shaped member on a side thereof opposite the tongue, the container having an opening adjacent the front of the loop-shaped member;

a cover connected to the loop-shaped member and releasably covering the opening in the container, the cover being spaced-apart from the front of the loop-shaped member with an opening therebetween for receiving a second end of the belt, whereby the container is uncovered when the container is hingedly moved away from the loop-shaped member and the cover.

2. A buckle as claimed in claim 1, wherein the container has a latch which releasably engages the cover.

3. A buckle as claimed in claim 1, wherein the container is dimensioned to receive a condom.

4. A belt buckle as claimed in claim 1, wherein the means for connecting includes a clamp.

5. A belt comprising:

a flexible strap having a first end and a second end;

a loop-shaped member having a front and a back;

means for connecting the first end of the strap to the back of the loop-shaped member;

an elongated tongue hingedly connected to the back of the loop-shaped member and extending to the front thereof on one side thereof;

a container hingedly connected to the back of the loop-shaped member on a side thereof opposite the tongue, the container having an opening adjacent the front of the loop-shaped member;

a cover connected to the loop-shaped member and releasably covering the opening in the container, the cover being spaced-apart from the front of the loop-shaped member with an opening therebetween for receiving the second end of the strap, whereby the container is uncovered when the container is hingedly moved away from the loop-shaped member and the cover.

6. A belt as claimed in claim 4, wherein the container has a latch which releasably engages the cover.

7. A belt as claimed in claim 4, wherein the container is dimensioned to receive a condom.

* * * * *